US012072166B2

(12) United States Patent
D'Acquisto

(10) Patent No.: US 12,072,166 B2
(45) **Date of Patent: *Aug. 27, 2024**

(54) BOW HOLDER

(71) Applicant: Andrae T. D'Acquisto, Bellevue, IA (US)

(72) Inventor: Andrae T. D'Acquisto, Bellevue, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/450,777

(22) Filed: Aug. 16, 2023

(65) Prior Publication Data

US 2023/0392894 A1 Dec. 7, 2023

Related U.S. Application Data

(63) Continuation of application No. 17/324,227, filed on May 19, 2021, now Pat. No. 11,732,996.

(51) Int. Cl.
*F16M 13/02* (2006.01)
*F41B 5/14* (2006.01)

(52) U.S. Cl.
CPC ..... *F41B 5/1453* (2013.01)

(58) Field of Classification Search
CPC ..... F41B 5/1453
See application file for complete search history.

(56) References Cited

U.S. PATENT DOCUMENTS 3,219,299 A 11/1965 Snider et al.
3,256,872 A 6/1966 Koser
3,926,393 A 12/1975 Tainsh
3,991,780 A 11/1976 Maroski, Jr.
4,144,971 A 3/1979 Balibrea
4,708,221 A 11/1987 Kubiak
4,846,140 A 7/1989 DiMartino
4,854,066 A 8/1989 Canterbury, Sr.
4,936,415 A 6/1990 Williams
5,039,052 A 8/1991 Carafice
5,044,590 A 9/1991 Carafice
5,106,044 A 4/1992 Regard, III et al.
5,111,800 A 5/1992 Reynolds
5,186,276 A 2/1993 Craig
5,240,211 A * 8/1993 Anderson ..... F41B 5/14 248/125.3
5,377,657 A 1/1995 Foster et al.
5,465,933 A 11/1995 Todd
5,482,241 A 1/1996 Oglesby
D376,832 S 12/1996 Mills
5,619,981 A 4/1997 Breedlove
5,622,342 A 4/1997 Mills
D379,399 S 5/1997 Reinaker
(Continued)

OTHER PUBLICATIONS

Muddy Treestands Universal Platform Bow Holder, Black; Hunting Tree Stand Accessories; Sports Outdoors; Amazon.com, accessed May 6, 2022; 7 pages.

*Primary Examiner* — Amy J. Sterling
(74) *Attorney, Agent, or Firm* — RYAN KROMHOLZ & MANION, S.C.

(57) ABSTRACT

A bow holder is vertically and horizontally adjustable for holding limbs of an archery bow during hunting. A securement mechanism couples a fixed limb of the bow holder to the tree stand. A vertically adjustable limb is coupled to the fixed limb. A series of rungs hold variable position o-rings in position for side-to-side securement of the bow to the bow holder.

4 Claims, 4 Drawing Sheets

(56) References Cited

U.S. PATENT DOCUMENTS

| | | | | |
|---|---|---|---|---|
| 5,630,568 | A | 5/1997 | Lubrecht | |
| 5,680,939 | A | 10/1997 | Oliver | |
| 5,775,658 | A | 7/1998 | Englehardt | |
| 5,819,462 | A | 10/1998 | Dockery | |
| 5,967,475 | A | 10/1999 | Johnson | |
| 6,059,240 | A | 5/2000 | Gorsuch | |
| 6,086,026 | A | 7/2000 | Pearce | |
| 6,131,556 | A | 10/2000 | Villarreal | |
| 6,205,992 | B1 | 3/2001 | Meeks et al. | |
| 6,349,905 | B1 | 2/2002 | Mills | |
| 6,425,765 | B1 | 7/2002 | Irwin, III | |
| 6,457,685 | B1 | 10/2002 | Taylor | |
| 6,561,477 | B1 | 5/2003 | Prive | |
| 6,663,059 | B1 * | 12/2003 | Warren | A45F 3/44 248/156 |
| 6,749,170 | B1 | 6/2004 | Rhoads | |
| 6,948,690 | B1 | 9/2005 | Sandel | |
| 7,163,183 | B2 | 1/2007 | Sutherland et al. | |
| 8,231,095 | B2 * | 7/2012 | Bean | F41B 5/14 248/323 |
| 8,240,432 | B2 | 8/2012 | Call | |
| 8,733,227 | B1 | 5/2014 | Ridgeway et al. | |
| 8,882,070 | B2 | 11/2014 | Bean et al. | |
| 9,282,734 | B2 | 3/2016 | Clary | |
| D760,916 | S | 7/2016 | Schlipf | |
| 9,593,803 | B1 * | 3/2017 | Roddenberry | F41A 23/18 |
| 9,593,903 | B1 * | 3/2017 | Sanchez | F16M 13/02 |
| D837,921 | S * | 1/2019 | Wright, III | D22/107 |
| D861,112 | S | 9/2019 | Lott et al. | |
| 10,412,954 | B1 | 9/2019 | Ellinghuysen | |
| 10,690,434 | B1 * | 6/2020 | Ding | F41A 23/14 |
| 10,757,930 | B2 | 9/2020 | Ellinghuysen | |
| 11,029,122 | B2 | 6/2021 | Ellinghuysen | |
| 2002/0066446 | A1 | 6/2002 | Kesti | |
| 2004/0147212 | A1 | 7/2004 | Leili et al. | |
| 2005/0035249 | A1 | 2/2005 | Busuito | |
| 2007/0215763 | A1 | 9/2007 | Krasnicki | |
| 2009/0090830 | A1 | 4/2009 | Bean et al. | |
| 2009/0189030 | A1 | 7/2009 | Krasnicki | |
| 2009/0278296 | A1 | 11/2009 | Fulcher et al. | |
| 2010/0065701 | A1 | 3/2010 | Fletcher | |
| 2010/0102184 | A1 | 4/2010 | Gorsuch et al. | |
| 2010/0171008 | A1 | 7/2010 | Bean | |
| 2010/0313864 | A1 | 12/2010 | Gardner et al. | |
| 2011/0251023 | A1 | 10/2011 | Fedriga | |
| 2012/0104201 | A1 | 5/2012 | Bean | |
| 2012/0175190 | A1 | 7/2012 | Schlipf | |
| 2015/0152999 | A1 | 7/2015 | Colarusso | |
| 2017/0127809 | A1 | 5/2017 | Georgiadis | |
| 2020/0355461 | A1 * | 11/2020 | Ellinghuysen | A47F 7/0021 |

* cited by examiner

BOW HOLDER

RELATED APPLICATIONS

This application is a Continuation of application Ser. No. 17/324,227, filed 19 May 2021 (now U.S. Pat. No. 11,732,996).

BACKGROUND OF THE INVENTION

Hunters use tree stands to elevate off of the ground to gain a better vantage point from which to hunt wild game. While hunting, hunters may prefer to stow their archery equipment to avoid carrying it during the entirety of the hunt. It is often convenient to use a bow holder to easily and accessibly hold the bow until game approaches, at which point the hunter will remove the bow from the bow holder for use.

SUMMARY OF THE INVENTION

A bow holder is vertically and horizontally adjustable for holding limbs of an archery bow during hunting. A securement mechanism couples a fixed limb of the bow holder to the tree stand. A vertically adjustable limb is coupled to the fixed limb. A series of rungs hold variable position o-rings in position for side-to-side securement of the bow to the bow holder.

By using two limbs, the bow holder can be made into a right or left tree stand side facing bow holder.

The rotational aspect of the present invention also allow for the bow holder to face backwards which is popular with saddle hunters.

DETAILED DESCRIPTION OF EMBODIMENTS

Figure 1:
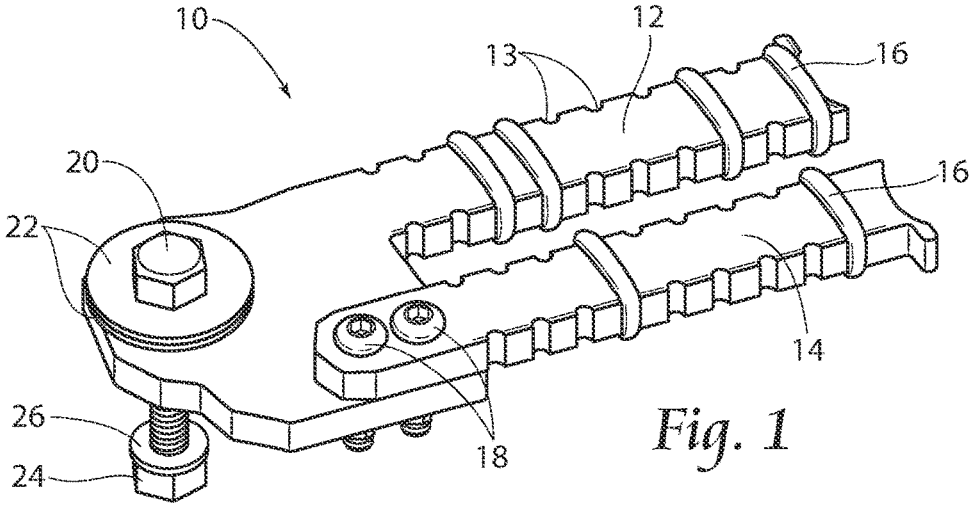
FIG. 1 is a perspective view of a bow holder of the present invention.
Figure 2:
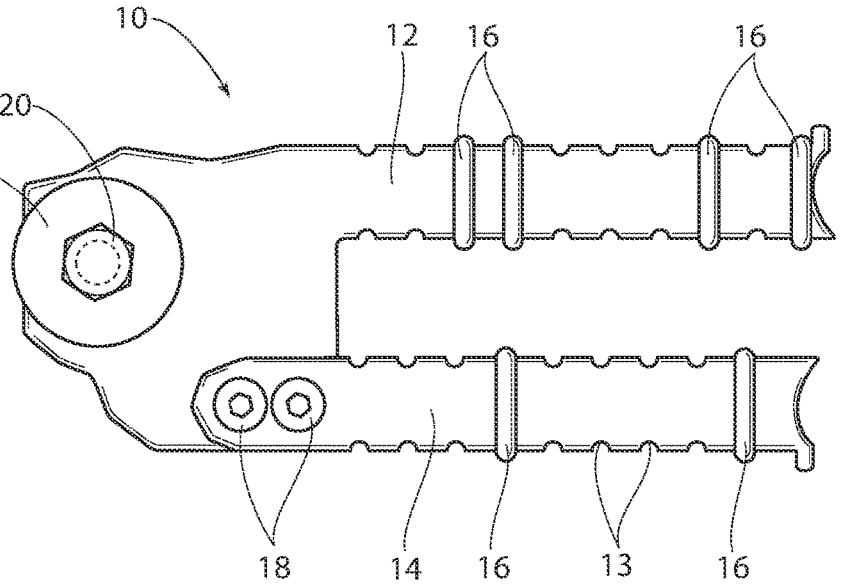
FIG. 2 is a top view of the bow holder of the present invention.
Figure 3:
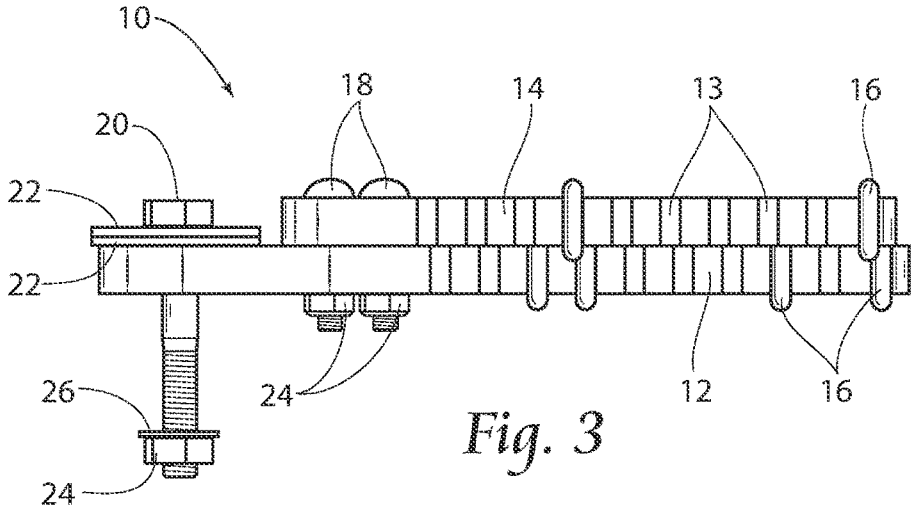
FIG. 3 is a side view of the bow holder of the present invention.
Figure 4:
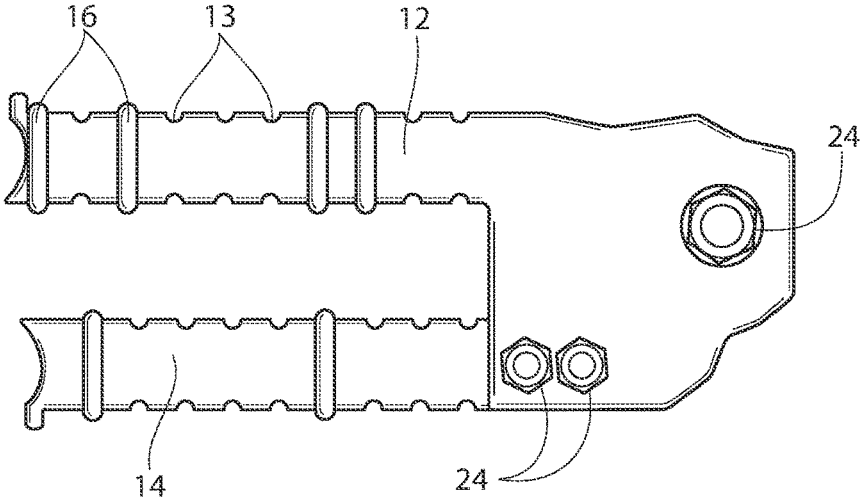
FIG. 4 is a bottom view of the bow holder of the present invention.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Referring now to FIGS. 1-4 a perspective, top, side and bottom views of a bow holder 10 of the present invention are shown. A preferably P shaped fixed limb 12 is coupled to a vertically adjustable limb 14 coupled to said fixed limb 12. A rotatable mount 20 is coupled to said fixed limb 12 for coupling said bow holder 10 to a tree stand as will be described later.

Preferably on both limbs 12 and 14 of bow holder 10, a plurality of spaced apart track lugs 13 are provided. Track lugs 13 are spaced apart horizontally, and carry a plurality of O-rings 16. Track lugs 13 also provide a measure of stability and grip to eliminate the bow from sliding left to right or leaning along the stand while sitting or in-use. The position of O-rings 16 on fixed limb 12 and vertically adjustable limb 14 can be changed to accommodate bow limbs of different widths and configurations, and also provides the opportunity to lean forward or backward at a preferred angle. If for instance a single limb bow is used, two of the O-rings 16 can accommodate each side of the limb, and restrain the bow from side-to-side movement. If for instance a split limb bow is used, four O-rings 16 can be employed, two each for each of the split limbs. The spacing of the O-rings 16 can be changed to accommodate fatter or thinner limbs.

To provide for additional adjustability and customization, vertical adjustment screws 18 are provided to provide a variable amount of separation between fixed limb 12 and vertically adjustable limb 14. Vertical adjustment screws 18 can also be removed, and vertically adjustable limb placed on the other side of fixed limb 12, in order to make the bow holder into a right or left tree stand side facing bow holder.

Figure 6:
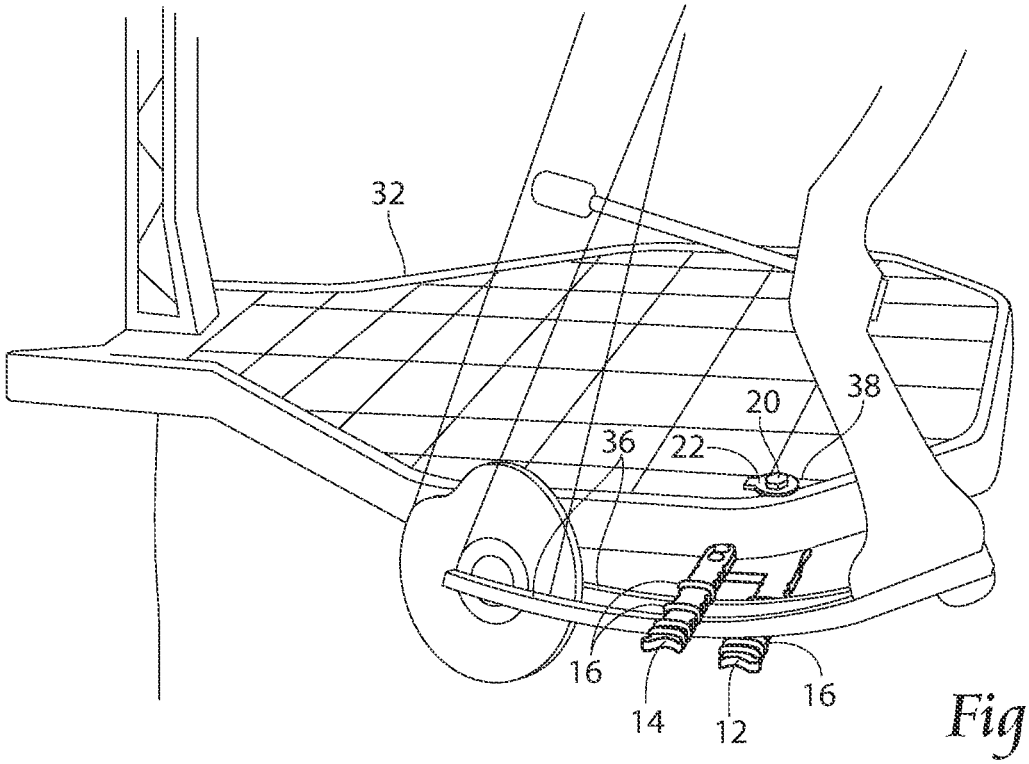
FIG. 6 is an in-use view of the bow holder of the present invention.

Rotatable mount 20 is coupled to said fixed limb 12 for coupling said bow holder 10 to a tree stand by providing a pair of washers 22, between which will fit a portion of a tree stand as shown in FIG. 6. Nut 24 and washer 26 allow for variation and tightening the washers 22 about the portion of the tree stand.

Figure 5:
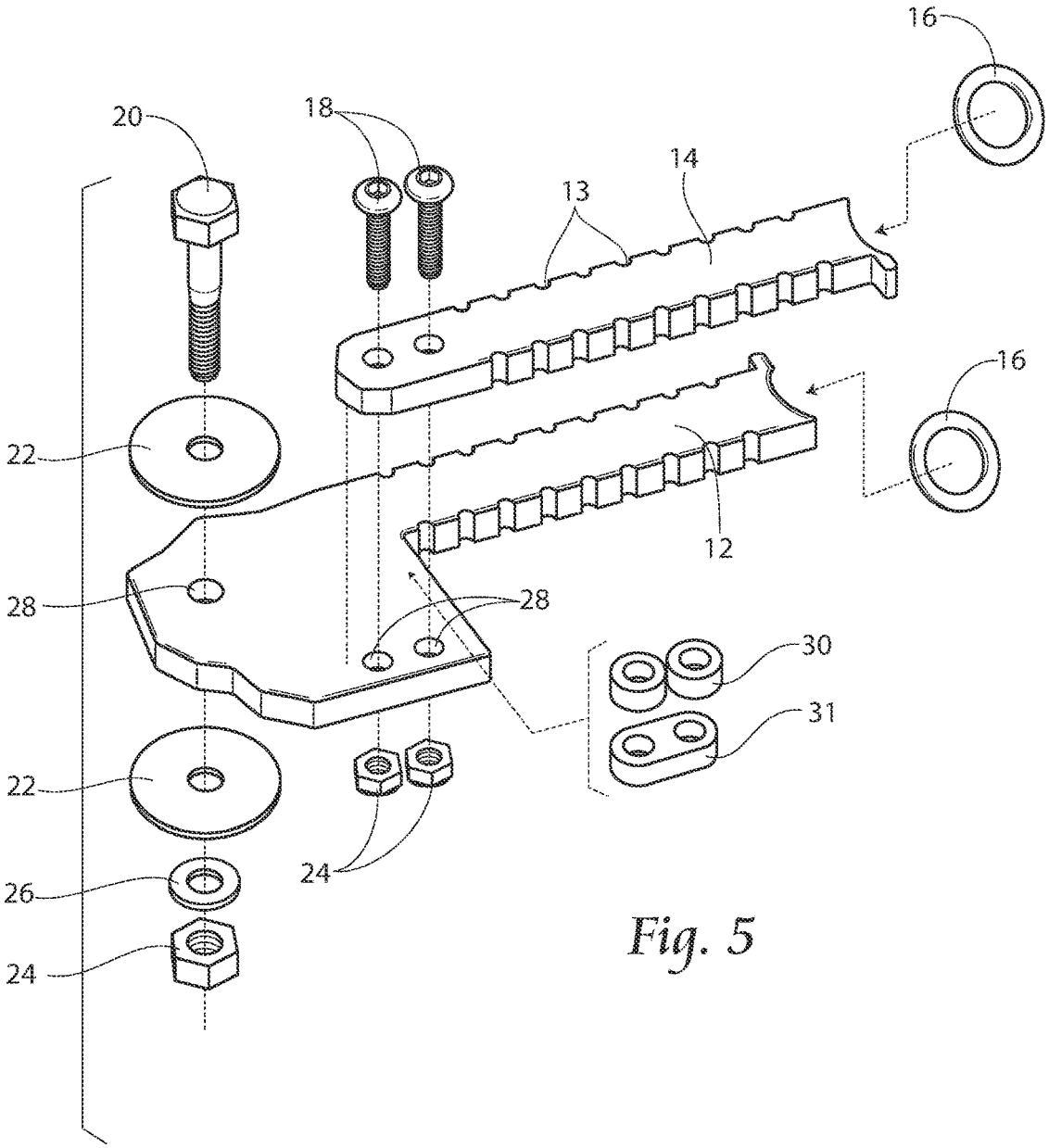
FIG. 5 is an exploded perspective view of the bow holder of the present invention.
Figure 7:
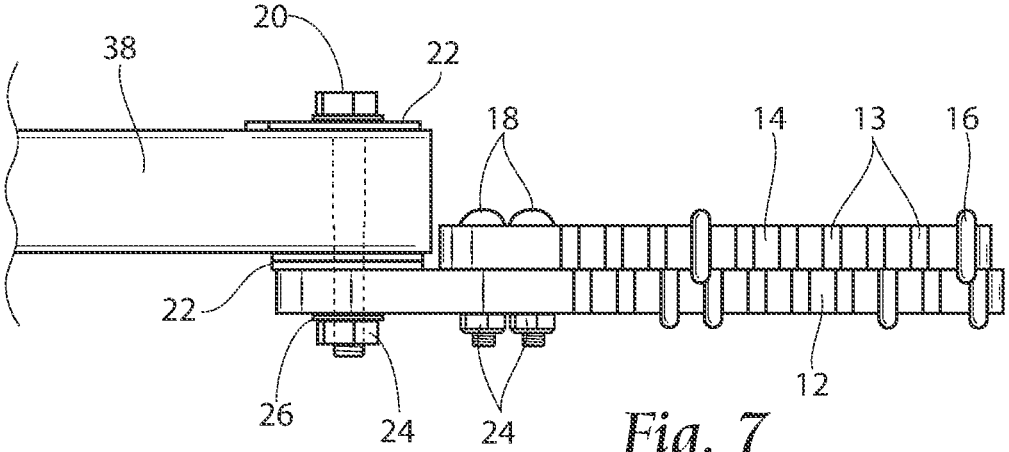
FIG. 7 is a side view of the bow holder of the present invention with a vertically adjustable limb positioned at a first elevation.
Figure 8:
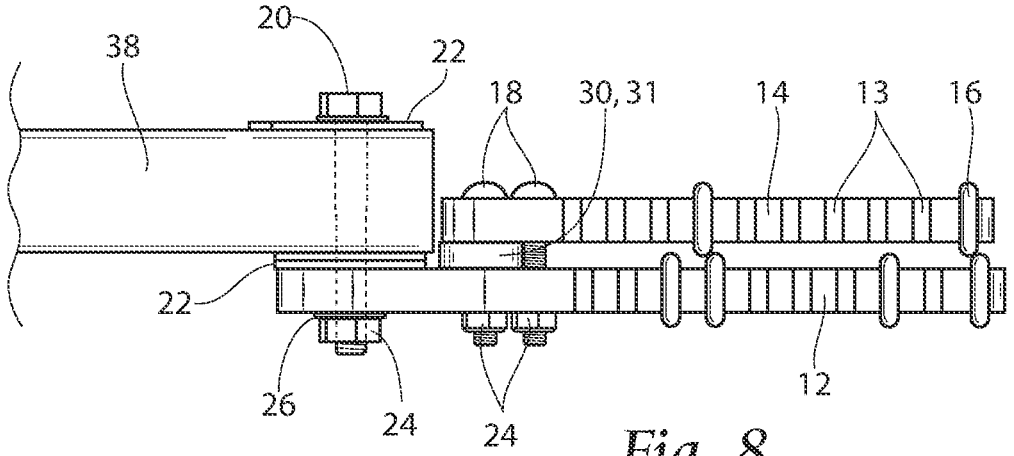
FIG. 8 is a side view of the bow holder of the present invention with a vertically adjustable limb positioned at a second elevation.

Referring now to FIG. 5 an exploded perspective view of the bow holder of the present invention is shown. Bolt void spaces 28 are provided in the fixed limb 12 and the variable limb 14 to accommodate bolts 18 and 20. Additionally, spacers 30/31 are shown. Either a pair of spacers 30 can be provided to vary the amount of separation between fixed limb 12 and vertically adjustable limb 14, or a single spacer with two receivers 31 can be provided. Spacers 30/31 can be provided with different heights in order to provide further or different adjustability between fixed limb 12 and vertically adjustable limb 14, as shown in FIGS. 7 and 8. Alternatively to spacers 30/31, for example an adjustable bolt, washers, screws or any other means can be used to provide different spacing between limbs 12/14.

Referring now to FIG. 6 an in-use view of the bow holder 10 is shown. Tree stand 32 is typically provided with a plurality of support struts 38 for the hunter to stand upon. Bow 34 may have a single or split limbs 36. In the displayed embodiment, O-rings 16 have been adjusted on the fixed limb 12 to accommodate each side of each split limb, and O-rings have been adjusted on the variable height limb 14 to also fit the configuration of limbs 36. Rotatable tree stand bolt mount 20 is shown securing a washer 22 to the top of a strut 38, and an additional washer 22 is secured to the bottom of strut 38 (concealed from view).

If a hunter wishes to move the bow holder 10 out of the way during periods of non-use, rotatable tree stand bolt mount 20 can be slightly loosened, and the fixed limb 12 can be rotated underneath the tree stand strut 38.

Figure 9:
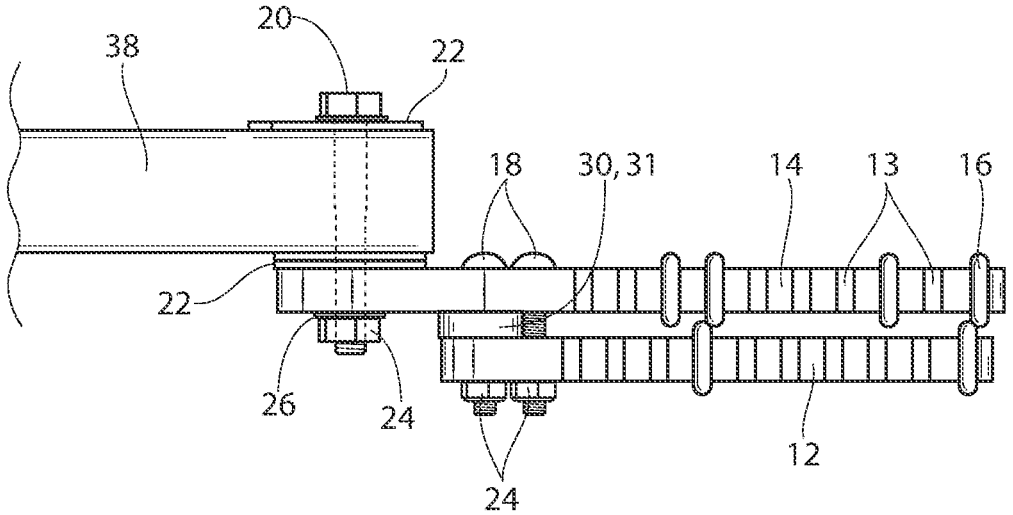
FIG. 9 is a side view of the bow holder of the present invention with a vertically adjustable limb positioned beneath a fixed limb of the bow holder.

Referring now to FIGS. 7 and 8, fixed limb 12 is depicted as being below vertically adjustable limb 14. However, vertically adjustable limb 14 can be positioned below fixed limb 12 as well, by removing couplings 18 and placing vertically adjustable limb 14 below fixed limb 12, and re-coupling couplings 18 as shown in FIG. 9. In this manner, the hunter has the choice as to which limb is placed on top. Right handed hunters may prefer one orientation over another, depending on which side (right or left) of the tree stand the bow holder 10 is placed. Conversely, left handed hunters may prefer one orientation over another, depending on which side (right or left) of the tree stand the bow holder 10 is placed.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

The invention claimed is:

1. A bow holder for carrying a bow, said bow holder attachable to a tree stand presenting a substantially horizontal standing surface, said bow holder comprising:

a first limb;

a second limb coupled to said first limb;

said first limb and said second limb rotatably coupled to said tree stand, said first limb and said second limb rotatable about an axis perpendicular to said substantially horizontal standing surface;

said first limb and said second limb spaced apart at a selectively variable vertical separation;

said first limb and said second limb spaced apart at a constant distance between distal ends of said first and second limb during rotation of said limbs about said axis;

said first and said second limbs spaced apart to create a gap to receive a limb of said bow within said gap.

2. A bow holder according to claim 1, wherein said first limb and said second limb are parallel and spaced apart with a variable vertical separation.

3. A bow holder according to claim 1, at least one of said first limb and said second limb rotatable from an in-use position extending from said substantially horizontal standing surface of said tree stand, to a second position not extending from said substantially horizontal standing surface.

4. A bow holder for carrying a bow, said bow holder attachable to a tree stand presenting a substantially horizontal standing surface, said bow holder comprising:

a first limb and a second limb rotatable from an in-use position extending from said substantially horizontal standing surface of said tree stand, to a non-use position;

said first limb and said second limb spaced apart horizontally to receive a limb of said bow;

said first limb and said second limb variably spaced apart vertically.

* * * * *